United States Patent [19]

Chan

[11] 3,936,963

[45] Feb. 10, 1976

[54] TENNIS SCORING DEVICE

[75] Inventor: Kingsley Chan, Saratoga, Calif.

[73] Assignee: Kingsley Chan, Saratoga, Calif.

[22] Filed: Aug. 12, 1974

[21] Appl. No.: 496,713

[52] U.S. Cl. ..... 40/70 R; 235/116; 35/74; 116/120

[51] Int. Cl.[2] ..... G09F 11/04

[58] Field of Search ..... 40/70 R, 21 C, 107, 114, 40/115; 35/74; 116/120; 235/114–122

[56] References Cited

UNITED STATES PATENTS

| | | | |
|---|---|---|---|
| 199,130 | 1/1878 | Whitelaw | 235/115 |
| 214,234 | 4/1879 | Brady | 235/116 |
| 985,655 | 2/1911 | Brown | 235/116 |
| 1,454,263 | 5/1923 | Beskow | 235/116 |
| 3,122,851 | 3/1964 | Sepe | 40/70 |
| 3,730,131 | 5/1973 | Izzo | 116/120 |

*Primary Examiner*—John H. Wolff

*Attorney, Agent, or Firm*—Limbach, Limbach & Sutton

[57] ABSTRACT

A wrist-worn tennis scoring device including a back having wrist mounting straps and a pivot post to receive a stack of five discs, the first two of which are rotatable and have separately colored index tabs which project outwardly from the disc peripheries, the tabs being rotatably alignable with score figures on the fifth or face disc. The third disc is rotatable and has a series of numbers in a circle around its periphery and between the third and face discs is a rotatable, transparent fourth disc having a second set of numbers in a circle concentric with the circle of numbers on the third disc. The face disc has a pair of diametrically opposed holes through which the numbers on the third and fourth discs can be observed. The tab indicator positions record the player point scores within each game and the numbers appearing in the face disc windows record the number of games scored in each set by each player.

7 Claims, 7 Drawing Figures

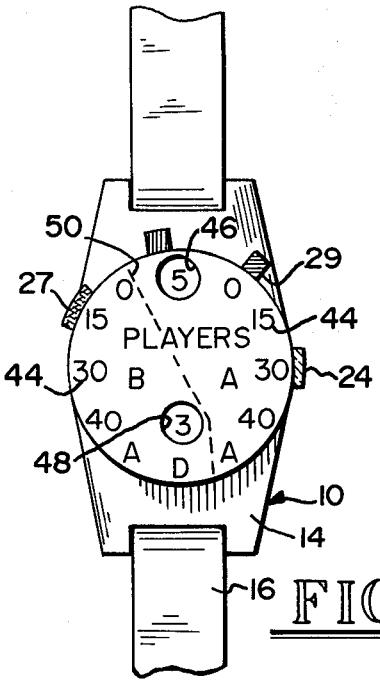
FIG. 1
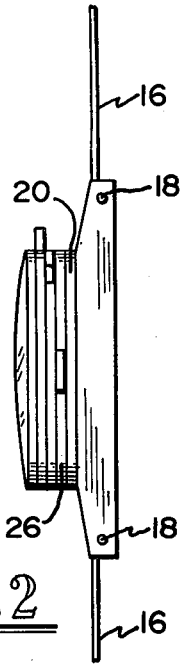
FIG. 2
FIG. 5
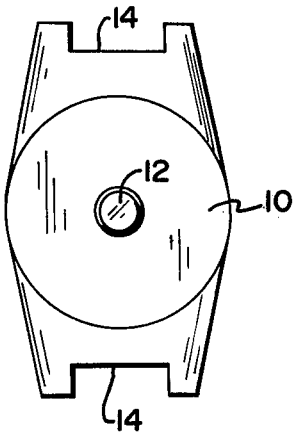
FIG. 3
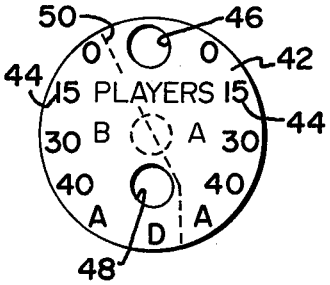
FIG. 4
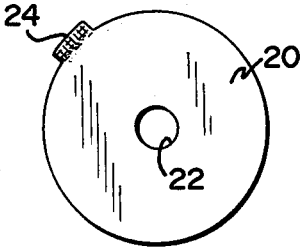
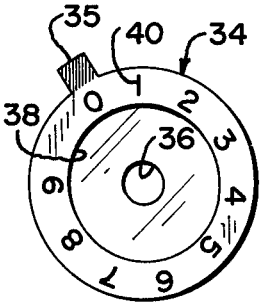
FIG. 6
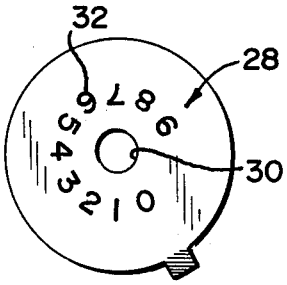
FIG. 7

TENNIS SCORING DEVICE

BACKGROUND OF THE INVENTION

The present invention relates to a portable game scoring register and, more particularly, to a wrist-mounted, tennis scoring register.

While tennis score computing devices and wrist-worn register mechanisms are previously known, such devices generally use complicated mechanisms in which knobs or buttons are used to activate a series of gears which in turn operate indicators. Most of these mechanisms are relatively complicated to manufacture, are not particularly durable and because of their complexity, may not be manufactured cheaply enough to be put into popular use.

SUMMARY OF THE INVENTION

The above and other disadvantages of prior art scoring devices are overcome by the present invention of a device for recording both the number of points scored by each of two players in a game and the number of games scored by each player in a set of games, the device comprising a back having a projecting pivot post, a first disc rotatably mounted on the pivot post adjacent to the back and having a first tab projecting radially outwardly from the disc periphery, a second disc rotatably mounted on the pivot post adjacent to the first disc and having a second tab projecting radially outwardly from its periphery, a third disc rotatably mounted on the pivot post adjacent to the second disc and having a third tab projecting radially outwardly from its periphery and further having a first circle of scoring characters on its surface facing away from the second disc, and a fourth disc rotatably mounted on the pivot post adjacent to the third disc and having a fourth tab projecting radially outwardly from its periphery and further having a second circle of scoring characters, which are the same as the first circle of scoring characters, arranged concentrically with the first circle on the surface of the fourth disc which faces away from the third disc, the fourth disc having a circular, optically transparent portion in alignment with the first circle of scoring characters.

The face or fifth disc is fixedly mounted on the pivot post and has two sets of corresponding scoring characters arranged in separate hemicircles on its surface facing away from the fourth disc. The face disc has two windows, the first window being in alignment with the first circle of scoring characters and the second window being in alignment with the second circle of scoring characters. The radius of the face disc is less than the radial distance of the first and second tabs from the pivot post so that the first and second tabs are rotatably alignable with the individual scoring characters of the respective hemicircles on the face of the fifth disc and the third and fourth discs are rotatable to align the scoring characters of the first and second circles with the first and second windows in the fifth disc, respectively.

In the preferred embodiment, the back is mounted on a wrist strap and the first and second circles of scoring characters correspond to the game count of a tennis set and the hemicircularly arranged scoring characters correspond to the point count of an individual tennis game within a set.

It can thus be seen that the scoring device of the invention utilizes a relatively simple mechanism which is both inexpensive to manufacture and is reliable.

It is therefore an object of the present invention to provide a wrist-worn device for recording both the number of points scored by each of two players in a game and the number of games scored by each player in a set of games.

It is another object of the invention to provide a wrist-worn, tennis scoring device having individually rotatable discs for indicating both the point and game scores of each of two players.

It is still another object of the invention to provide a wrist-worn score recording device which is mechanically simple and reliable.

The foregoing and other objectives, features and advantages of the invention will be more readily understood upon consideration of the following detailed description of the preferred embodiments of the invention, taken in conjunction with the accompanying drawings.

BRIEF DESCRIPTION OF THE DRAWINGS

FIG. 1 is a plan view of a score keeping device according to the invention;

FIG. 2 is a side view in elevation of the score keeping device depicted in FIG. 1;

FIG. 3 is a plan view of the face disc of the score keeping device depicted in FIG. 1;

FIG. 4 is a plan view of a point indicating disc of the score keeping device depicted in FIG. 1;

FIG. 5 is a plan view of the back for the score keeping device depicted in FIG. 1;

FIG. 6 is a plan view of the outermost game scoring disc of the recording device depicted in FIG. 1; and FIG. 7 is a plan view of the inner game scoring disc of the recording device depicted in FIG. 1.

DETAILED DESCRIPTION OF THE PREFERRED EMBODIMENT

The scoring device of the invention has particular use in recording tennis scores and, as indicated above, records the point scores and the game scores of the two players. The device includes a back 10 having a projecting pivot post 12 and a pair of forked edges 14 to which the ends of a wrist strap 16 are attached by pins 18 in a manner similar to that used in the construction of wristwatches.

A first disc 20 is rotatably mounted on the pivot post 12 with the pivot post 12 projecting through a center hole 22 in the disc 20. A tab 24 projects radially outwardly from the periphery of the disc 20. The disc 20 is positioned immediately adjacent to the back 10. A second disc 26, which is substantially of the same construction as the disc 20, is rotatably mounted on the pivot post 12 adjacent to the disc 20. The disc 26 has a projecting tab 27 corresponding to the tab 24.

Referring now more particularly to FIG. 7, a third disc 28 is rotatably mounted on the pivot post 12, adjacent to the disc 26, and has the pivot post 12 projecting through a center hole 30 in the disc 28. The disc 28 has a tab 29 which projects radially outwardly from the disc periphery. A first circle of scoring characters 32 are arranged around the hole 30. The scoring characters 32 correspond to the numerals 0, 1, 2, 3, 4, 5, 6, 7, 8 and 9 which can represent the games of a tennis match, for example. The numbers are each imprinted so as to be readable right-side up when each number is in the six o'clock position on the disc 28. A fourth disc 34, shown in FIG. 6, is rotatably mounted on the pivot post 12 with the pivot post 12 projecting through a center hole 36 in the disc 34. A tab 35 projects radially outwardly from the periphery of the disc 34. As shown in FIG. 1, the tabs 29 and 35 extend radially further from the pivot post 12 than the tabs 24 and 27 to facilitate the rotational adjustments of the discs 28 and 34 without disturbing the positions of the discs 20 and 26. The disc 34 has an optically transparent portion 38 which is in alignment with the circle 32 of scoring characters on the subjacent disc 28. The disc 34 has a second circle of scoring characters 40 which correspond to the first circle of scoring characters 32 on the disc 28. The scoring characters 40 are each imprinted so as to be right-side up when viewed in the twelve o'clock position on the disc 34. The circle 40 is arranged concentrically with the circle 32 on the disc 28 so that the scoring characters in the circle 32 are visible through the transparent portion 38 of the disc 34. AS depicted in FIGS. 6 and 7, the radius of the circle of characters 32 is less than the radius of the circle 40 of characters. However, in other embodiments, these dimensions can be reversed, and the transparent portion 38 can be rearranged accordingly.

Referring now more particularly to FIG. 3, an outer face disc 42 is fixedly mounted on the pivot post 12 so as to be non-rotatable. On the surface of the disc 42, facing away from the disc 34 and located about its periphery, are a pair of hemicircularly arranged sets of scoring characters 44. The scoring characters 44 represent the individual point scores of a tennis game for each of two sets of players. The player characters "A" and "B" are also imprinted on the same surface. A pair of diametrically opposed windows 46 and 48 are located in the disc 42 such that the window 46 is aligned with the circle of scoring characters 40 and the window 48 is aligned with the circle of scoring characters 32.

In the completely assembled device depicted in FIG. 1, it can be seen that the tabs 24 and 27 of the disc 20 and 26, respectively, are rotatably alignable with the separate hemicircularly arranged sets of scoring characters 44 to record the separate point scores of the players A and B within an individual game. The tabs 29 and 35 of the discs 28 and 34, respectively, are rotatably alignable so as to make different scoring characters of the circles 32 and 40 appear in the windows 46 and 48 of the face disc 42, respectively. The numbers appearing in the windows 46 and 48 thus indicate the number of games scored within a set of games by the players A and B. The face disc 42 may be divided by a suitable indicating line 50 so as to separate the scores of the players A and B.

While the wrist-scoring device of the present invention has been particularly described above with reference to recording the scores of tennis games, it should be apparent that it is equally applicable to scoring other types of games in which individual point scores are recorded and individual game scores of a set of games are recorded between two players.

The terms and expressions which have been employed here are used as terms of description and not of limitation, and there is no intention, in the use of such terms and expressions, of excluding equivalents of the features shown and described, or portions thereof, it being recognized that various modifications are possible within the scope of the invention claimed.

What is claimed is:

1. A score recording device comprising:

a back member having a face and a pivot post projecting from the face;

a first disc rotatably mounted on the pivot post and having a first tab projecting radially outwardly from its periphery;

a second disc rotatably mounted on the pivot post and having a second tab projecting radially outwardly from its periphery;

a third disc rotatably mounted on the pivot post and having a first circle of scoring characters on its surface facing away from the face of the back member;

a fourth disc rotatably mounted on the pivot post, the surface of the fourth disc facing away from the third disc having both a second circle of scoring characters arranged concentrically with the first circle of scoring characters and an annular transparent portion radially aligned with the first circle of scoring characters, the first, second, third and fourth discs being arranged on the pivot post such that the first circle of scoring characters is otherwise visible through the transparent portion of the fourth disc and the first and second circles of scoring characters are otherwise visible when looking toward the face of the back member; and a fifth, cover disc fixedly mounted on the pivot post and having two sets of scoring characters arranged in separate hemicircles on its surface facing away from the face of the back member, the first and second tabs being visible beyond the periphery of the cover disc and being rotatably alignable with the individual scoring characters of the respective hemicircles on the face of the cover disc by rotation of the first and second discs, respectively, the cover disc further having a first window in alignment with the first circle of scoring characters and a second window in alignment with the second circle of scoring characters such that selected ones of the scoring characters of the first and second circles of scoring characters can be made to appear in the first and second windows, respectively, by rotation of the third and fourth discs, respectively.

2. A score recording device as recited in claim 1 further comprising a wrist strap and wherein the back is mounted on the wrist strap.

3. A score recording device as recited in claim 1 wherein the third disc has a third tab projecting radially outwardly from its periphery, the fourth disc has a fourth tab projecting radially outwardly from its periphery, and the first, second, third and fourth tabs project radially beyond the outer peripheries of the succeeding discs in the outward direction from the back and are individually distinguishable.

4. A score recording device as recited in claim 3 wherein the third and fourth discs have individually distinguishing colors.

5. A score recording device as recited in claim 1 wherein the first and second circles of scoring characters correspond to the game count of a set of tennis games and the hemicircularly arranged scoring characters correspond to the point of an individual tennis game within a set.

6. A device for recording both the number of points scored by each of two players in a game and the number of games scored by each player in a set of such games, the recording device comprising:

a back having a projecting pivot post;

a first disc rotatably mounted on the pivot post adjacent to the back and having a first tab projecting radially outwardly from its periphery;

a second disc rotatably mounted on the pivot post adjacent to the first disc and having a second tab projecting radially outwardly from its periphery;

a third disc rotatably mounted on the pivot post adjacent to the second disc and having a third tab projecting radially outwardly from its periphery and further having a first circle of scoring characters on its surface facing away from the second disc;

a fourth disc rotatably mounted on the pivot post adjacent to the third disc and having a fourth tab projecting radially outwardly from its periphery and further having a second circle of scoring characters which are the same as the first circle of scoring characters, arranged concentrically with the first circle, on the surface of the fourth disc which faces away from the third disc, the fourth disc having a circular, optically transparent portion in alignment with the first circle of scoring characters; and a fifth disc fixedly mounted on the pivot post and having two sets of corresponding scoring characters arranged in separate hemicircles on its outer surface facing away from the fourth disc, the fifth disc further having a first window in alignment with the first circle of scoring characters and a second window in alignment with the second circle of scoring characters, the radius of the fifth disc being less than the radial distance of the first and second tabs from the pivot post, the first and second tabs being visible beyond the periphery of the fifth disc and being rotatably alignable with the individual scoring characters of the respective hemicircles on the face of the fifth disc by rotation of the first and second discs, respectively, and the third and fourth discs being rotatable to align the scoring characters of the first and second circles with the first and second windows in the fifth disc, respectively.

7. A score recording device as recited in claim 6 wherein the first and second tabs and the third and fourth tabs extend to different radial distances from the pivot post.

* * * * *